US006719475B2

(12) United States Patent
Arkwright

(10) Patent No.: US 6,719,475 B2
(45) **Date of Patent: *Apr. 13, 2004**

(54) ADHESIVE FASTENER ASSEMBLY FOR FILE FOLDER PAPERS

(76) Inventor: George A. Arkwright, 9105 Chickawane Ct., Alexandria, VA (US) 22309

( * ) Notice: Subject to any disclaimer, the term of this patent is extended or adjusted under 35 U.S.C. 154(b) by 0 days.

This patent is subject to a terminal disclaimer.

(21) Appl. No.: 10/237,127

(22) Filed: Sep. 9, 2002

(65) Prior Publication Data

US 2003/0081985 A1 May 1, 2003

Related U.S. Application Data

(63) Continuation-in-part of application No. 09/494,250, filed on Jan. 31, 2000, now Pat. No. 6,447,196, which is a continuation-in-part of application No. 09/095,695, filed on Jun. 11, 1998, now abandoned, which is a continuation-in-part of application No. 08/521,538, filed on Aug. 30, 1995, now abandoned, which is a continuation-in-part of application No. 08/162,875, filed on Dec. 8, 1993, now abandoned, which is a continuation-in-part of application No. 08/099,458, filed on Jul. 30, 1993, now abandoned, and a continuation-in-part of application No. 08/059,374, filed on May 12, 1993, now abandoned, and a continuation-in-part of application No. 08/389,677, filed on Feb. 14, 1995, now abandoned, which is a continuation-in-part of application No. 08/174,325, filed on Dec. 30, 1993, now abandoned, and a continuation-in-part of application No. 08/162,844, filed on Dec. 7, 1993, now abandoned, and a continuation-in-part of application No. 08/059,374.

(51) Int. Cl.[7] ..... B42F 3/00

(52) U.S. Cl. ..... 402/8; 24/67 R; 24/67 AR; 281/15.1; 281/21.1; 281/45; 402/60

(58) Field of Search ..... 402/8, 60, 79; 24/67 R, 67.11, 67 AR; 462/71, 75; 281/15.1, 21.1, 23, 28, 38, 45

(56) References Cited

U.S. PATENT DOCUMENTS

| | | | | | |
|---|---|---|---|---|---|
| 4,127,690 | A | * | 11/1978 | Schleifenbaum et al. | 428/40.1 |
| 4,657,960 | A | * | 4/1987 | Shuman et al. | 524/270 |
| 4,684,685 | A | * | 8/1987 | Shuman et al. | 524/270 |
| 4,699,538 | A | * | 10/1987 | Caine | 402/79 |
| 4,807,907 | A | * | 2/1989 | Lancaster | 462/18 |
| 5,143,404 | A | * | 9/1992 | Flowers, Jr. | 281/21.1 |
| 5,169,254 | A | * | 12/1992 | Arkwright | 402/8 |
| 5,667,322 | A | * | 9/1997 | Mucznik | 402/8 |
| 5,683,194 | A | * | 11/1997 | Emmel et al. | 402/79 |
| 5,810,498 | A | * | 9/1998 | Hirai | 402/18 |
| 5,873,601 | A | * | 2/1999 | Peleman | 281/21.1 |
| 6,309,130 | B1 | * | 10/2001 | Johnson et al. | 402/4 |
| 6,447,196 | B1 | * | 9/2002 | Arkwright | 402/8 |

* cited by examiner

*Primary Examiner*—Monica S. Carter
(74) *Attorney, Agent, or Firm*—Shlesinger, Arkwright & Garvey

(57) ABSTRACT

A file paper adhesive fastening assembly has an engaging element for engaging an upper edge section of a support panel, and has a plurality of relatively small superposed flexible fastening pieces held together in a flap-like manner along their upper edges, and each fastening piece has an adhesive element at approximately the midsection of its undersurface for engaging and supporting the top edge section of a paper sheet to be mounted on the support panel.

18 Claims, 4 Drawing Sheets

ADHESIVE FASTENER ASSEMBLY FOR FILE FOLDER PAPERS

CROSS-REFERENCE TO RELATED APPLICATIONS

This application is a continuation in part of application Ser. No. 09/494,250 filed Jan. 31, 2000 now U.S. Pat. No. 6,447,196 was a continuation-in-part of Ser. No. 09/095,695 filed Jun. 11, 1998 now abandoned, which was a continuation-in-part of Ser. No. 08/521,538, filed Aug. 30, 1995 now abandoned, which was a continuation-in-part of application Ser. No. 08/162,875, filed Dec. 8, 1993 now abandoned, which was a continuation-in-part of application Ser. No. 08/059,374, filed May 12, 1993 now abandoned, and also a continuation-in-part of application Ser. No. 08/099,458, filed Jul. 30, 1993, now abandoned. Application Ser. No. 08/521,538 now abandoned, filed Aug. 30, 1995, above, was also a continuation-in-part of application Ser. No. 08/389,677, filed Feb. 14, 1995 now abandoned, which was a continuation-in-part of application Ser. No. 08/174, 325, filed Dec. 30, 1993 now abandoned, and was also a continuation-in-part of application Ser. No. 08/059,374, filed May 12, 1993 now abandoned, and a continuation-in-part of application Ser. No. 08/162,844, filed Dec. 7, 1993, now abandoned.

BACKGROUND OF THE INVENTION

This invention related to a recently developed type of adhesive. The file folder fastener which fastens paper sheets in a file folder. It is related to a new type of fastener which is mounted on a file folder prong type fastener and uses an adhesive to engage and hold a paper sheet in position in a file folder. It is described in Arkwright U.S. Pat. No. 5,159,254 dated Dec. 8, 1992, and further described in my co-pending application Ser. No. 09/494,250 filed Jan. 31, 2002.

The adhesive fastener is a paper thin generally rectangular piece which secures a file paper in a file folder without requiring two-hole punching the paper prior to mounting it on the metal fastener prongs.

The adhesive fastener is a relatively small, flexible rectangular piece that has two space punched holes for mounting it on the prong fastener, and an adhesive strip on the underside of the adhesive fastener to bent up to access a release covering strip mounted on an adhesive strip. The upper section portion of the paper to be filed is inserted under the adhesive fastener, and the adhesive covering strip is removed. The strip of adhesive then engages the surface of the inserted paper sheet adjacent its top edge.

The adhesive fastener makes it possible to more quickly place a sheet in a file. There is no need to two-hole punch the paper document. The paper sheet can be inserted quickly. There is no need to open the metal fastener, this eliminates two-hole punching the paper to be inserted, opening the metal fastener by lifting the prongs, placing the paper on the prongs, and then bending the prongs down on the newly inserted paper sheet. The cost of the adhesive fastener in this instance is a factor which is weighed against the convenience of more rapidly inserting the paper sheet in file, or avoiding two hole defacing the inserted sheet. In the case of formal documents, such as certified court documents, or bank loan agreements ,which cannot be two-hole punched, the adhesive fastener has made it possible to secure these documents in a file folder without punching holes in them. Another factor also, is a paper secured by an adhesive fastener can individually be removed from the file without removing the file papers mounted on the prong and above it in the file.

However, where only the convenience of using the fastener is the principal factor, the cost of the fastener, has restricted its use in the general retail market.

Additionally, use of adhesive fasteners in color coded side tab shelf type-file folders was impractical. The lower edge of filed papers protruded out over a portion of the side tab. Because papers secured by an adhesive fastener are inserted in the file below the prong fastener, they are mounted lower in the file below the prong fastener, they are mounted lower in the file then papers mounted on the prong fastener. The medical industry almost exclusively uses side tab color coded side tab folders. The attempt to overcome this drawback by finding a satisfactory alternative to the prong fastener in this case led to the development of the modification of this invention. Another factor in the development was the knowledge from prior experience that an adhesive fastener split in half, as shown in my co-pending prior application, provided a fastener of sufficient strength to effectively secure and to maintain alignment of the paper filed.

Previous experience with the fastener also indicated that general acceptance of the adhesive fastener in the retail market required simplifying use of the adhesive fastener for installation of the paper sheet in the file.

Previous assumptions were that a high strength connection to the file folder was essential. However, after several years experience, it was apparent that very heavy duty connections were only required in a very small percentage of the file folders. On the basis of this knowledge, and the impetus to meet the shortcoming of the adhesive fastener arrangement in a side tab folder, it was recognized that the metal prong fastener could be eliminated.

The relatively high cost of the adhesive fasteners made it expensive to place more than several adhesive fasteners on the prongs at any one time. Consequently, the annoyance of the manipulation of prongs was not eliminated, but only reduced to some extent. Therefore, to obtain the full advantage of the adhesive fastener, a relatively large number of fasteners would have to be mounted in the file folder simultaneously, and the prong fastener eliminated completely. But most importantly, it would be necessary to substantially reduce the price of the adhesive fastener to make it practical economically to use the adhesive fastener for all papers filed.

SUMMARY OF THE INVENTION

This invention provides an adhesive fastener which can be sold to the general public for general use. Heretofore, use of the adhesive fastener had either a cost restriction or a prong mounting drawback, that resulted in confining the marketing of fasteners to special applications. For example, adhesive fasteners must be used for securing papers that cannot be two-hole punched. The features of the modified adhesive fastener of this invention provide a more user-friendly and substantially less expensive, adhesive fastener, making it practical to use with all types of papers in a file folder.

This invention features an adhesive fastener assembly with multiple fasteners which can be quickly mounted independently on a file folder. There is no reliance on prong fasteners. A contact adhesive provides sufficient holding strength. Eliminating the prong fastener as a support for adhesive fasteners removes the objection to use the adhesive fasteners for side tab shelf type folders. The support for the adhesive fasteners will be sufficient for use in most file folders.

With no need to rely on a two-hole mounting on a prong fastener, the length of the adhesive fastener can be reduced by almost half, providing a significant cost saving. The resulting lower market price, increases the sales volume sufficiently to make the adhesive fastener economically practical for widespread use.

The adhesive fastener of this invention is more user friendly than previously. This is also a factor in greater general acceptance of the adhesive fastener as a substitute for the conventional prong fastener. The ability to more readily remove the cover release piece from the adhesive fastener strip adds to convenience. The greater convenience of the adhesive fastener will affect the decision to switch from the prong fastener arrangement.

The modified adhesive fastener of this invention also results in quicker removal of a previously filed paper from the file folder. A slight pull upward on the free section below the adhesive strip of the adhesive fastener separates from the file paper. In contrast, a paper secured by a prong fastener cannot be removed from the middle of the file without removing all of the papers that are held on the prong fastener above it. When the removed file paper is to be returned to the file, it is only necessary to lift the fastener to which it had been attached and to reinsert the file paper to its previous position. This also is a large convenience which contributes to the decision to use file fasteners for all papers to be held in the file.

The modifications of this invention also provides for the unique covering and release piece. It provides the function of both a covering for the adhesive strip of the fastener and also a section which facilitates its removal, as well as upward bending of the next to be used adhesive fastener, to permit its attachment to the next paper sheet.

Accordingly, the convenience factor that favors use of an adhesive fastener, over prong fasteners is substantially increased by the modifications of this invention.

These and other features and advantages of this adhesive fastener invention will become apparent to those skilled in the art when taken with respect to the following detailed description of the preferred device.

DESCRIPTION OF THE INVENTION

Figure 1:
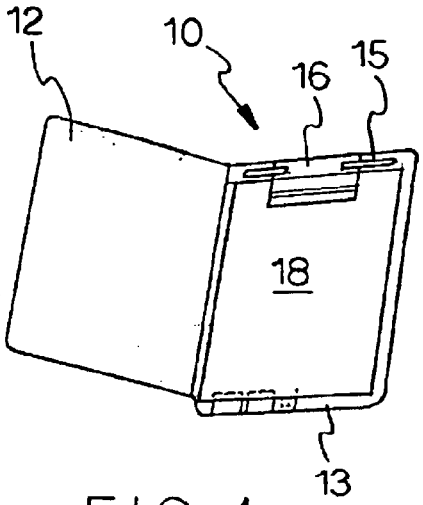
FIG. 1 is a perspective view of a file folder with a similar type of fastener assembly.
Figure 2:
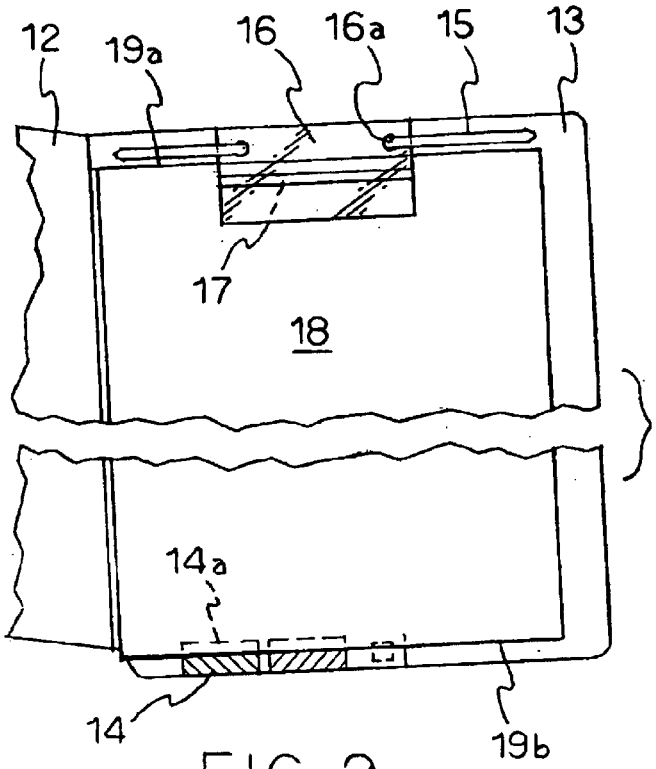
FIG. 2 is an enlarged partial view of FIG. 1.

Referring particularly to the drawings, FIGS. 1 and 2 illustrate a file folder for papers using the prior fastener assembly. FIG. 1 is a perspective view of a file folder, generally indicated at 10, having panels 12 and 13 within which file papers are mounted. A paper thin, flexible, rectangular fastener 16, one of a group of superposed similar fasteners, is positioned along the upper central edge of panel 13. A conventional metal prong fastener 15 passes through punched hole openings such as 16*a* in the flexible plastic fastener element element 16.

The adhesive fastener 16 has an adhesive strip 17 on its underside for engaging the top surface of the paper to be filed in the file folder 10. The construction and operation of this type of fastener is described in Arkwright U.S. Pat. No. 5,169,254, and my patent application Ser. No. 09/494,250 now U.S. Pat. No. 6,447,196 issued Sep. 9, 2002.

One of the drawbacks of the prong fastener type of mounting, for a side tab file folder, is shown in FIGS. 1 and 2. As shown, the prong fastener type mounting requires that filed paper is mounted lower than punched hole filed papers. The file paper 18 is held in position by the linear extending adhesive 17 on the underside of the adhesive fastener piece. However, with letter-sized file folders, the upper surface 19*a* of the file paper 18 cannot move upwardly beyond the part of fastener 15 extending up through the punched hole opening 16*a* of the adhesive fastener 16. As a consequence, as shown at the bottom side 19*b*, of file paper 18, extends downwardly more than papers that are two-hole punched and mounted directly on the metal file folder fastening prongs.

Consequently, as shown in FIG. 2, the color coded section 14 of the side tab file folder 10 is partially covered at 14*a*. Where side tab file folders are used, such as in medical record file systems, this overlap by the lower edge of file papers is objectionable.

Figure 3:
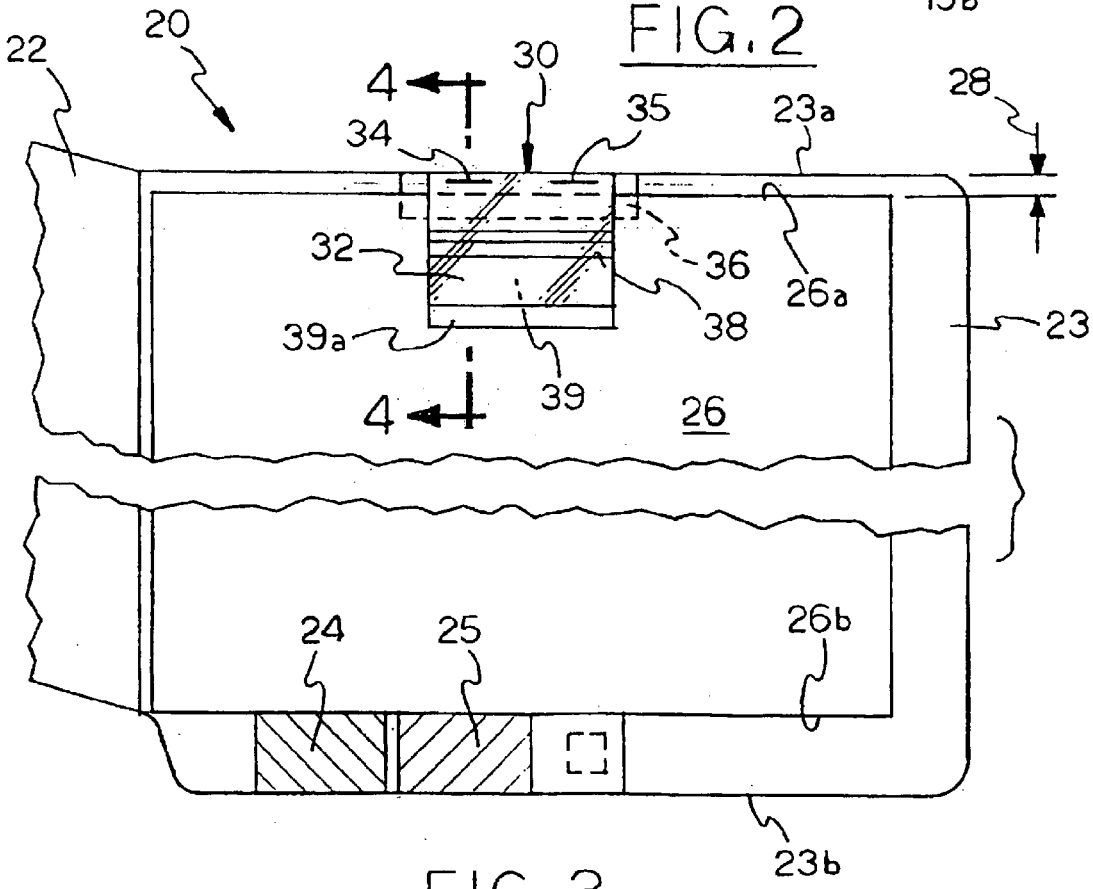
FIG. 3 is an enlarged partial plan view of a file folder panel having the fastener assembly of the subject invention mounted thereon.

The partial plan view of FIG. 3 shows a new type of a small paper thin fastener assembly construction which is directed to overcoming this problem and in providing a more readily mounted and usable adhesive fastener assembly, not requiring a prong fastener of FIGS. 1 and 2. The side tab file folder generally indicated at 20 has panels 22 and 23, which correspond to the side tab file folder panels shown in FIGS. 1 and 2. Folder Panel 23 has an upper edge 23*a* and a lower edge 23*b*. Adjacent to the lower edge 23*b* are different colored blocks, 24 and 25. These correspond to the color coded blocks 14*a* of FIG. 2.

The inserted letter-size file paper sheet 26 is mounted on panel 23 with its top edge 26*a* disposed parallel to the top edge 23*a* of panel 23. The lower edge of the file paper sheet 26*b* is disposed parallel to and from the lower edge 23*b* of panel 23. It is above and clear of the color blocks 24 and 25. This results because without the interfering metal prongs of the prong fastener, the file paper 26*a* can be placed closer to the file panel upper edge 23*a* as shown at 28.

Figure 4:
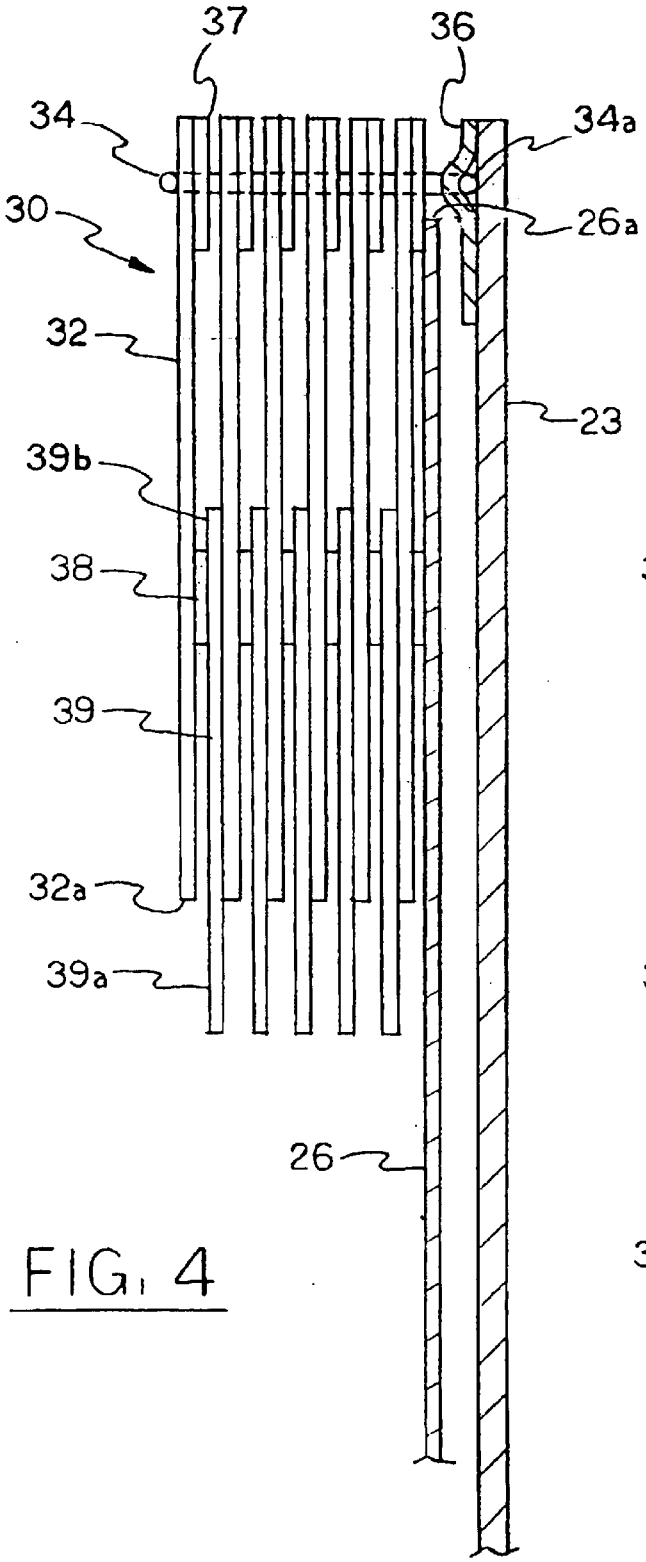
FIG. 4 is an enlarged cross-sectional view along line 4—4 of FIG. 3.

Paper 26 is held in position by one of the superposed rectangular, small, paper thin adhesive fasteners of the file fastening assembly as shown in FIG. 4. They are clear 2×1¼ inch pieces of polypropylene 2 mils in thickness. The multiple stack of rectangular plastic fasteners are held together by staples 34 and 35 which pass through the paper thin fastening pieces, as well as through an elongated thin and rectangular vinyl strip 36. The strip has a coating of strong adhesive which permanently engages the panel 23 along its upper mid portion immediately adjacent upper edge 23*a*.

The adhesive fastener pieces 32 are approximately half the length of the fasteners 16 of FIG. 1. The construction of the linear extending adhesive strip 38 is similar to the adhesive strip 17 shown in FIG. 2.

However, the covering and release piece for the adhesive strip of the adhesive strip is substantially different. The width of the covering strip for the adhesive 17 of FIG. 2 is the same width as the adhesive itself. But, in FIG. 3, this is not the case. The adhesive covering release piece 39 is a wide piece which covers both the adhesive strip 38, and extends below the lower edge 32*a* of the free section of the fastener 32. The extended section piece 329 is stiffer than the fastener to facilitate its removal. It has a silicone release layer on its top surface which provides a separating section 39*a*. The cross-sectional view of FIG. 4 shows this construction.

With respect to the mounting of the paper sheet 26 and the fastening assembly 30, it should be noted that the upper edge 26*a* of paper 26, can be moved closer to the panel upper edge 23*a*. With the substitution of the staple retention of the fastener pieces in the place of a prong fastener, it is possible to move paper sheets closer to the upper edge of the file folder panel.

The cross-sectional view of FIG. 4 illustrates the mounting arrangement using the staples 34 and 35. The staple passes through the fastener and a reinforcing and spacing strip 37, and through the vinyl adhering support strip 36. The adhesive strip is either a strong non-tearing plastic, such as Mylar, or a fabric type piece with a high tack permanent adhesive on its underside. The staple 34, as shown, has its bent section under the adhesive support strip 36 is shown at 34*a*.

Figure 5:
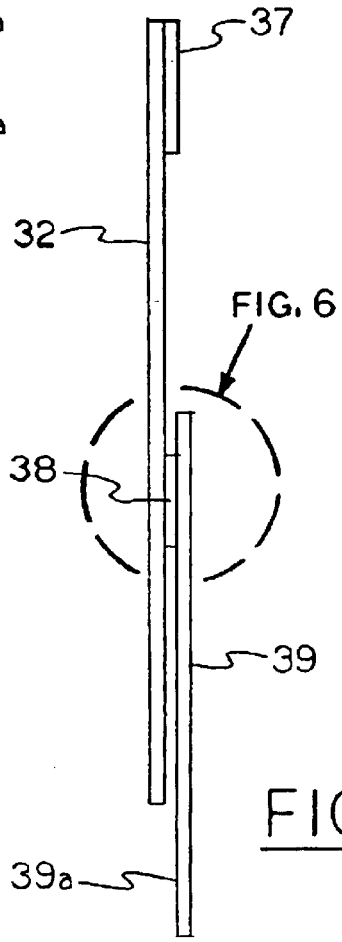
FIG. 5 is an enlarged side-view of one of the fastener elements of FIGS. 3 and 4.
Figure 6:
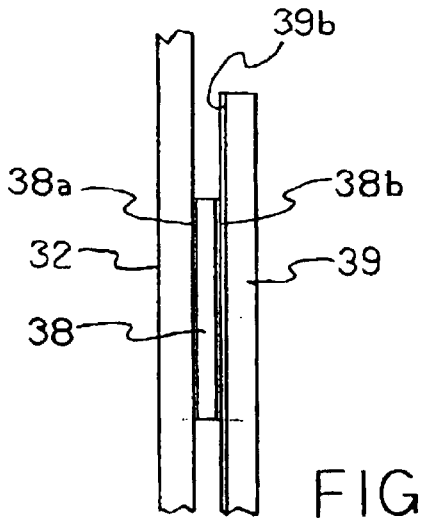
FIG. 6 is an enlarged partial view of FIG. 5 illustrating the construction at the adhesive section.

The arrangement of the cover and release piece 39 is shown in FIGS. 5 and 6. As shown in FIG. 6, the silicone release layer on the top surface of cover and release piece 39 engages the adhesive strip 38. The adhesive strip 38 is a tape that is a thin strip of plastic having a high tack adhesive layer 38*a* on its upper surface to hold it to the fastener piece 32, and, a medium tack (10–14 oz) adhesive layer 38*b*, which is in contact with release and cover piece 39. The strip corresponds to that of application Ser. No. 09/494,250, now U.S. Pat. No. 6,447,196.

The lower separating section 39*a* of the covering piece 39 functions as a separator of engaged and unengaged adhesive fasteners for selecting the next fastener to be used. It also provides a pull tab for separating and quick uncovering of the adhesive surface of the adhesive strip. The relative stiffness of this piece facilitates separation.

It should be noted that the adhesive fasteners 32 are extremely thin, having a thickness of about 2 mils (two thousandths of an inch). FIGS. 4 to 6 are magnified to illustrate the construction.

FIG. 5 is a side-view of an individual adhesive fastening element 32. The circled area, FIG. 6, is shown in further enlarged view in FIG. 6. It shows the adhesive tape section, with the adhesive tape 38 and the upper high tack layer 38*a* engaging the lower surface of the fastener piece 32. The lower paper engaging surface of the double-sided adhesive tape 38 has a medium tack layer 38*b*. The upper surface of the covering and release piece 39 has a silicone non-adhesive layer 39*b* which engages the medium tack adhesive 38*b*.

Figure 7:
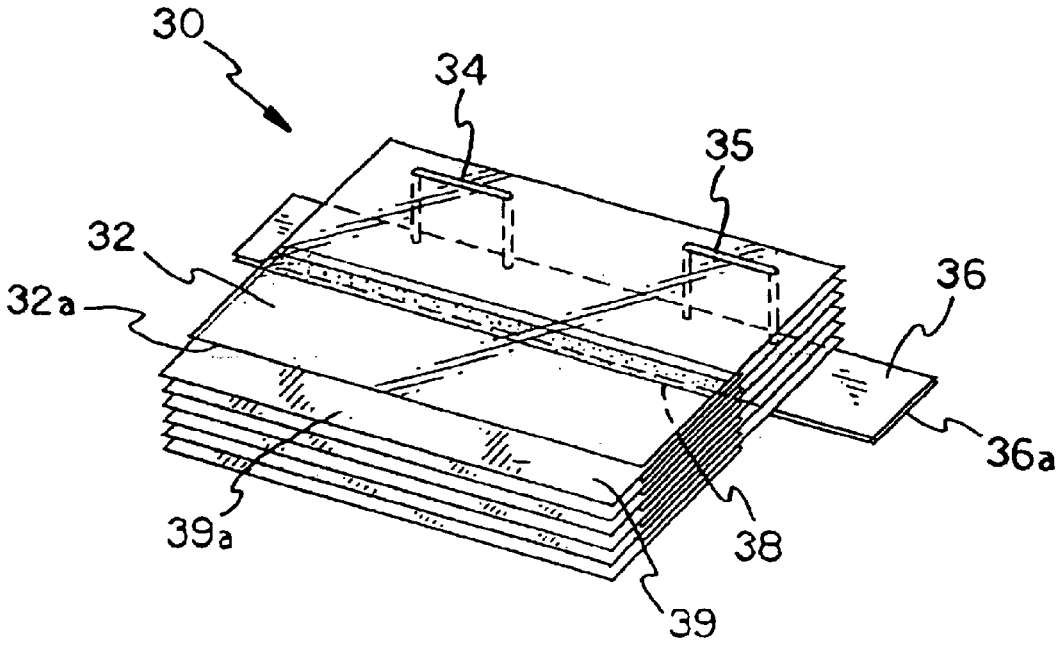
FIG. 7 is an enlarged perspective view of the fastener assembly of FIGS. 3 and 4.

A perspective view of the staple held stack of fasteners is shown in FIG. 7. The fastener assembly generally indicated at 30 has a stack of superimposed fastener pieces 32 held together by staple members 34 and 35, as a one-piece multiple adhesive fastener assembly. The support strip 36 is sufficiently strong to prevent the bent under staple holding section (39 FIG. 4) from pulling through it. Support strip 36 has a removable covering strip 36*a* which covers the very strong adhesive coating applied to the undersurface of vinyl strip 36. This construction eliminates the need for pre-installed prong fastener pieces. It also provides a ready usable number of fasteners. Eliminating the need to mount several fasteners on prongs before they can be used, provides a convenience for the user.

The covering and release piece 39 with its separating section 39*a* enables the user to quickly separate the bottom attached and above next and unattached fastener to be used (see FIG. 4). Piece 39 is lifted at its edge and then the top portion of the paper sheet is inserted. Separating section 39*a* is then pulled to expose the adhesive strip surface to the newly inserted paper sheet. With this construction, the time for inserting a paper sheet to a file folder is considerably reduced and simplified from that of the previous construction. The smaller size of the fastener elements has been found to be fully adequate to hold the papers in position. The reduced cost and the greater convenience of use, will permit expansion of sale to include retail market.

Figure 8:
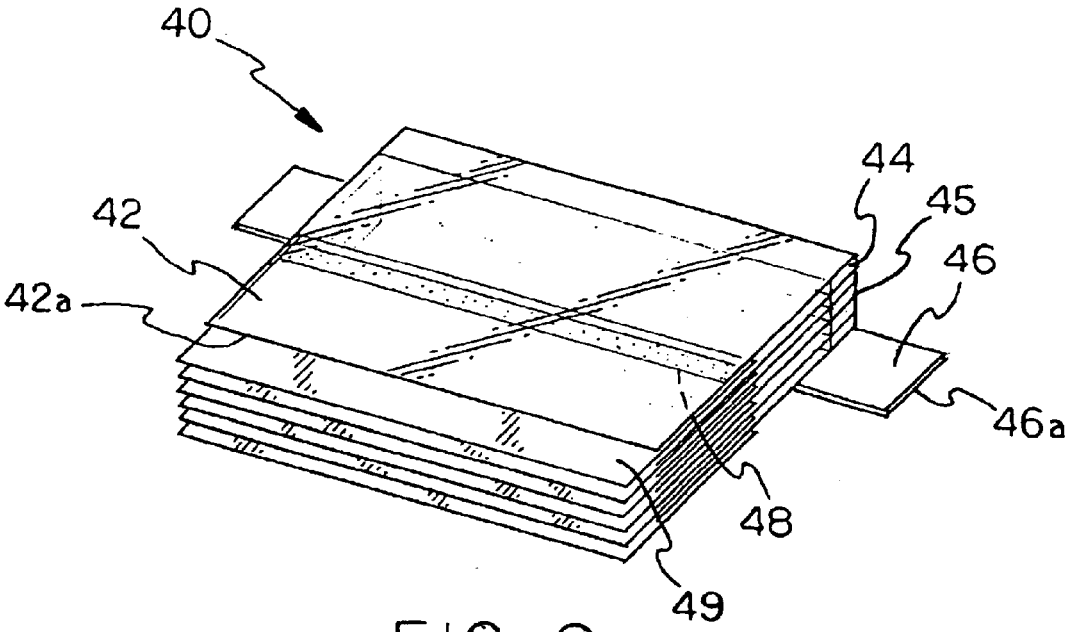
FIG. 8 is an enlarged perspective view of another modification of the fastener assembly of FIG. 7.

FIG. 8 is a perspective view of an adhesive fastener assembly where the fasteners are joined together at their upper ends by adhesive strips. It corresponds to the adhesive fastener assembly of the FIG. 7, where the adhesive fasteners are held together by staples 34 and 35. The fasteners such as fastener 42 are of the same construction as fastener 32. The fastener 42 has a lower edge 42*a*, and adhesive strip 48, and a release end covering piece 49 which correspond to that shown in FIG. 7. Adjacent the upper edge of the adhesive fastener 42, a double sided high tack adhesive strip 44 is disposed along the undersurface of fastener 42 to hold it together with the fastener 45 disposed immediately below it. This construction is repeated for each successive adhesive fastener in the assembly. The tape 46 and its removable cover piece 46*a* correspond to the support tape 36 of FIG. 7. The high tack double sided tape arrangement provides sufficient strength to hold and support the adhesive fasteners and the papers attached to them in the file.

Figure 9:
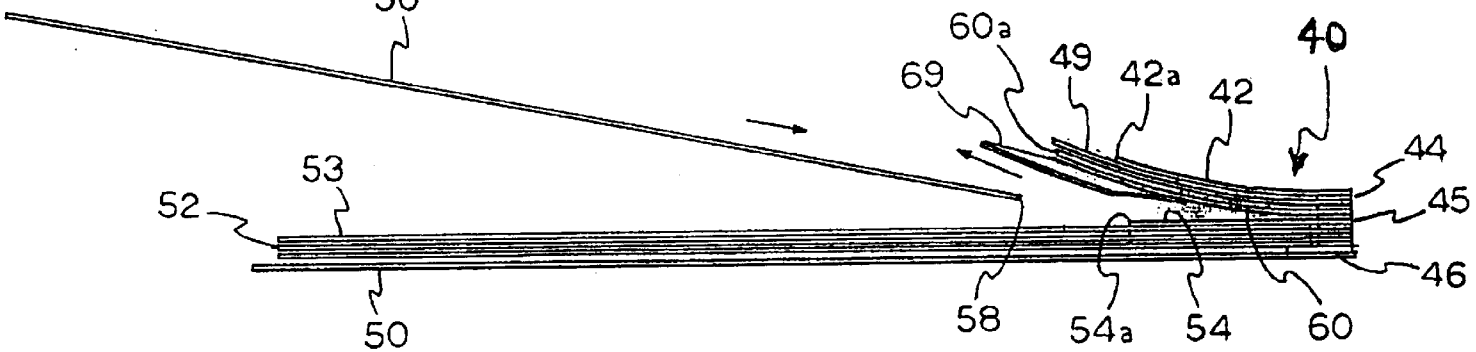
FIG. 9 is a side-view of the modification of FIG. 8 illustrating the insertion of a paper in the fastener assembly.

FIG. 9 is a side view of the panel 50 of a file folder showing a file paper sheet as it is being inserted on a panel. The fastener assembly 40 is shown mounted on the panel 50 of a file folder which has previously mounted paper sheets 52 mounted thereon. The uppermost mounted sheet 53 is held in position by the fastener 54 which has a lower edge 54*a*. The paper sheet 56 is shown as it is being inserted about fastener 54.

The fastener assembly 40 as shown is held to the uppermost edge of panel 50 by the vinyl support strip 46 which has a permanent high tack adhesive layer 46*a*. (FIG. 8).

All of the adhesive fastener pieces such as the uppermost fastening piece 42 are held together in superposed positioned by intermediate securing strips 45. These strips each have a high tack adhesive on both the upper and lower surfaces to hold adjacent top edges of the fastening devices together.

The release and covering strip 49 extends below the lower edge 42*a* of the fastener 42, as shown in FIGS. 8 and 9. This is significant, since it permits the user to readily separate the upper unused fastener, such as fastener 60, from the lower attached fasteners such as fastener 54.

The release and covering piece 69 extends below the lower edge 60*a* of fastener 60. The separator section 69*a* of cover piece 69 is merely lifted up. The relatively stiffer piece 69 bends back the more flexible fastener 60 and the it separates from the fastener, exposing the adhesive. The paper sheet 56 is moved into the opening to a final position close to the securing strip between fasteners 54 and 60.

The cover and release piece 69 is in pulled free from the underside of the fastener 60 and discarded. The adhesive strip on the underside of fastener 60 can then engage the upper surface of the sheet 56 to hold it in position.

FIG. 9 illustrates the simplicity of the fastener assembly construction with the ready ability to fasten the entire assembly quickly to the top edge central section of a file folder panel, and also the ability to separate the lowermost next unused fastener, and then to also simultaneously remove the covering on the underside adhesive over the reusable medium tack.

Figure 10:
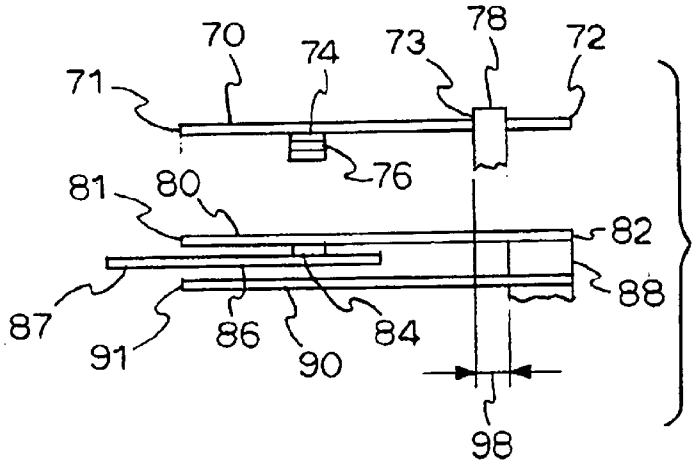
FIG. 10 is a comparative side-view of the fasteners of FIGS. 2 and 8.

FIG. 10 is a comparative view of the fastener 70, the adhesive fastener shown in FIGS. 1 and 2, and the adhesive fastener 80, which corresponds to fastener 42 shown in FIGS. 8 and 9. Fastener 70 has lower edge 71 and an upper edge 72. A punched hole 73 accommodates the upright unbent section of prong 78. The double sided adhesive tape 74, which has a high tack adhesive on its upper surface, engages the lower surface of fastener 70. The reusable medium tack adhesive is on the undersurface of the double sided tape 76, and is covered by a removable covering and release piece not shown.

The fastener 80 is shown below and aligned with fastener 70 to illustrate the differences between the two fasteners. Fastener 80 has a lower edge 81 and an upper edge 82. A double sided adhesive tape 84 similar to adhesive 76 is attached to the mid portion of the fastener 80. A wide release and covering piece 86 has a release surface, on its upper surface such as silicone, which engages the medium tack adhesive on the underside of tape 84 to permit a ready removal of the covering piece 86. Covering piece 86 has an extended lift and removing section 87 which extends beyond the lower edge 81 of the fastening device 80. The fastener 80 is held at end 82 in engagement with adjacent fasteners by the double sided high tack tape 88.

The fastener 90, partially shown correspond to the fastener 54 of FIG. 9. Its lower edge is shown at 91. The two arrows with space in between, shown at 98, illustrates that the prong 73 presents a stop which is further down approximately ¼ inch than the securing of tape 88. This is relevant, as discussed with respect to the comparison of FIGS. 2 and 3, and the lower edge of paper sheets extending over the color coded sections of the folders shown in FIG. 2.

While this invention has been described as having a preferred design, it is understood that it is capable of further modifications, and uses and/or adaptations of the invention and following in general the principle of the invention and including such departures from the present disclosures as come within the known or customary practice in the art to which the invention pertains, and as may be applied to the central features hereinbefore set forth, and fall within the scope of the invention or limits of the claims appended hereto.

What is claimed:

1. A file paper adhesive fastening assembly, comprising:

a) a plurality of superposed adhesive fastening pieces for engaging and supporting a paper sheet in a file folder;

b) each adhesive fastening piece being a relatively small, flexible, piece having a releasable adhesive element at the mid-section of the piece for engaging a paper to be filed;

c) the adhesive fastening pieces being held together along their upper edge section;

d) a securing element connected to at least the lowermost adhesive fastening piece to support all of the fastening pieces along the top central section of on a panel of the file folder.

2. The file paper adhesive fastening assembly as set forth in claim 1, wherein;

a) the securing element is a length of material having an adhesive layer on its underside for engaging the surface of a file folder adjacent its upper edge.

3. The file paper adhesive fastening assembly of claim 2, wherein:

a) the adhesive fasteners are paper thin flexible rectangular plastic pieces; and b) the removable adhesive layer is positioned on an undersurface of a longitudinally extending intermediate section of each adhesive fastener.

4. The file paper adhesive fastening assembly as set forth in claim 1, wherein;

a) a metallic staple extends through all of the adhesive fastening pieces and the securing element to hold the assembly together.

5. A paper fastening assembly, comprising:

a) a plurality of superposed adhesive fastener pieces having an adhesive layer at their central section for removably engaging a paper to be fastened to a mounting panel;

b) the adhesive fasteners being held together along a narrow common top edge section so that they can be supported in a flap-like manner to the mounting panel; and c) an adhesive mounting assembly which is connected to the adhesive fasteners at their common top edge section, and which has an element adapted to engage a central edge section of the mounting panel.

6. The paper fastening assembly as set forth in claim 5, wherein;

a) the mounting assembly securing element is a length of material having an adhesive coating on its underside for engaging a contact surface of the central edge section of the mounting panel.

7. The file paper adhesive fastening assembly as set forth in claim 6, wherein:

a) a binding strip of two sided adhesive tape is disposed along the upper edge and between adjacent adhesive fastening pieces to hold them together.

8. The file paper adhesive fastening assembly as set forth in claim 6, wherein:

a) the adhesive element is a strip of two sided adhesive tape disposed on the underside of each adhesive fastening piece; and b) the adhesive coating on the underside of the two sided adhesive tape is a medium tack layer of contact adhesive.

9. The file paper adhesive fastening assembly as set forth in claim 8, wherein:

a) a release and separating element is disposed over the medium tack contact adhesive, and has an engaging section which extends beyond the lower edge of the adhesive fastening pieces.

10. The file paper adhesive fastening assembly as set forth in claim 9, wherein:

a) the length of the adhesive fastening pieces is approximately two inches.

11. The file paper adhesive fastening assembly as set forth in claim 6, wherein:

a) the adhesive fasteners extend longitudinally along a top central section of the panel; and b) the adjacent adhesive fasteners are held together adhesively along their top edge section.

12. The file paper adhesive fastening assembly as set forth in claim 11, wherein:

a) a strip of tape having a permanent adhesive on each surface is disposed between the top edge sections of adjacent adhesive fasteners.

13. The paper fastening assembly as set forth in claim 5, wherein;

a) a staple extends through all of the adhesive fasteners and the mounting assembly.

14. The paper fastening assembly as set forth in claim 5, wherein:

a) a binding strip of two sided adhesive tape is disposed along an upper edge and between adjacent adhesive fasteners to hold them together.

15. The file paper adhesive fastening assembly as set forth in claim 5, wherein:

a) a length of the adhesive fasteners along an upper section is approximately two inches.

16. The file paper adhesive fastening assembly as set forth in claim 15, wherein:

a) a release and separating element is disposed over the adhesive layer; and b) the element has an engaging section which extends beyond a lower edge of a free section of adhesive fastening pieces.

17. The paper fastening assembly as set forth in claim 5, wherein:

a) the adhesive layer of the adhesive fastener is disposed on an exposable side of a strip of two sided adhesive tape; and b) the adhesive layer is a coating medium tack contact adhesive.

18. The file paper adhesive fastening assembly as set forth in claim 17, wherein:

a) the adhesive layer is disposed on an underside of each adhesive fastener and extends longitudinally along its mid-section.

* * * * *